US005271169A

United States Patent [19]

Konsztowicz

[11] Patent Number: 5,271,169

[45] Date of Patent: Dec. 21, 1993

[54] SNOW SHOVEL/PUSHER

[76] Inventor: Krzysztof J. Konsztowicz, 108 Lewis Drive, Bedford, Nova Scotia, Canada

[21] Appl. No.: 973,739

[22] Filed: Nov. 9, 1992

[51] Int. Cl.[5] ..... E01H 5/02

[52] U.S. Cl. ..... 37/271; 37/270; 37/285

[58] Field of Search ..... 37/285, 270, 271, 265, 37/264, 266, 219; 294/53.5, 54.5

[56] References Cited

U.S. PATENT DOCUMENTS

| | | | |
|---|---|---|---|
| 2,185,052 | 12/1939 | Daugherty | 37/285 X |
| 2,544,505 | 3/1951 | Kronhaus | 37/285 X |
| 2,811,792 | 11/1957 | Cork, Jr. | 37/270 X |
| 2,863,232 | 12/1958 | Steinbach et al. | 37/270 X |
| 3,643,356 | 2/1972 | Gohl | 37/271 X |
| 4,531,713 | 7/1985 | Balboni | 37/285 X |
| 5,074,064 | 12/1991 | Nickels | 37/285 X |
| 5,123,187 | 6/1992 | Zamaria | 37/285 X |

*Primary Examiner*—Randolph A. Reese
*Assistant Examiner*—J. Russell McBee
*Attorney, Agent, or Firm*—R. Craig Armstrong

[57] ABSTRACT

The device includes a blade and a handle whereby the device may be used as a conventional snow pusher. Skis or skids below the blade support the blade at an angle relative to the ground, and may raise the blade 5 cm or so off the ground surface, so that the blade does not snag the ground during pushing. Left and right struts support the skis from the blade. The struts are collapsible, and when collapsed the skis lie tucked away against the back of the blade, whereby the device may be used as a shovel.

8 Claims, 9 Drawing Sheets

SNOW SHOVEL/PUSHER

BACKGROUND OF THE INVENTION

This invention relates to a device for assisting a person carrying out the task of clearing snow, for example from a driveway.

Motorized snow blowers and throwers of course make light of the task of removing snow from a driveway, etc.. But there are times when the use of such motorised machines is inappropriate, and in any event the machines can be expensive. The invention is concerned with a device for enabling a person to use his own forceful physical movements to the best advantage, so that a person may conveniently remove snow without resorting to motorised machines.

Apart from motorised machines, the ordinary shovel is a commonly employed device for moving snow, but the use of a shovel requires that the snow be lifted and thrown, repeatedly, so that conventional shovelling is regarded as somewhat too strenuous.

A common alternative to the ordinary shovel is the snow pusher, in which a blade is pushed through the snow, like a hand-held snow plow. A characteristic of the snow pusher, which is unlike the snow shovel, is that during operation of the device the device rests on the ground. People prefer to use the pusher device, rather than the shovel, because the shovel involves the strenuous task of repeatedly lifting the snow, and indeed lifting the shovel. The use of the pusher device is less arduous because the device remains in contact with the ground.

However, with the conventional snow pusher device, because the device remains in contact with the ground, problems arise when the ground is uneven. For example, when the device is used on an uneven surface, the edges and corners of the blade can become snagged in protrusions and crannies. This makes snow removal more irritating, because of the stoppages and interruptions to smooth movements. Another problem arises in that when the driveway is of gravel, moving snow with a snow pusher can lead to pebbles, etc. being picked up and moved along with the snow. This of course can damage the driveway surface, and the damage often can occur without the person being aware of the fact.

Particularly in the case of the snow pusher, it is important to maintain the pusher blade at a suitable angle relative to the horizontal ground surface, for efficient removal of the snow.

Snow pushers have been in common use for many years, and it has been proposed to place skis underneath the handle of a snow pusher, in order to maintain the pusher blade at the correct angle for pushing. U.S. Pat. No. 2,388,985 (Martin, 1944) is an example of this.

Snow shovels are also in common use, and it has been proposed to place skis under the blades of shovels, spades, and scoops, as shown for example in U.S. Pat. No. 2,484,409 (Jameson, 1946); in Canadian patent no. 687,138 (Neuman, 1964); and in Canadian patent no. 892,438 (Gohl, 1972).

SUMMARY OF THE INVENTION

The invention provides a device which combines the functions of snow pusher and snow shovel. The device includes a blade and suitable runners, preferably skids or skis, which rest on the ground, and which maintain the blade at the correct angle for pushing. The runners are mounted on a collapsible suspension system, and can be folded into a tucked-away position, and the device is so arranged that, when the suspension system is folded, the device may then be used as a simple shovel.

The suspension system is so structured into the device so that when the suspension system is collapsed, the various components of the suspension system, including the runners, remain tucked out of the way to a sufficient extent as to permit the device to be used as a shovel.

When the suspension system is collapsed or folded, the device is compact enough for easy storage, for example by hanging the device on the wall of a garage, etc..

Preferably, there is handle with two laterally spaced-apart members incorporating blade support means on which the blade is mounted. The device includes left and right skis, pivotally attached to the blade support means, and pivotable between a folded storage or shovelling position, and an unfolded plowing position, where preferably they are held in position by collapsible struts, as will be described in greater detail later herein.

Preferably, the blade is movable along the blade support means, so that the height of the forward lower edge of the blade may be adjusted relative to the ground level; that is to say, the ground level as determined by the runners. By keeping the blade above the ground level, the device may be easily pushed even over a loose or uneven ground surface without snagging or digging-in, and without displacing loose pebbles or otherwise disrupting the surface.

Details of the invention will be described or will become apparent during the course of the following detailed description.

BRIEF DESCRIPTION OF THE DRAWINGS

By way of further explanation of the invention, an exemplary embodiment of the invention will now be described with reference to the accompanying drawings, in which.

DETAILED DESCRIPTION OF PREFERRED EMBODIMENT

Figure 1:
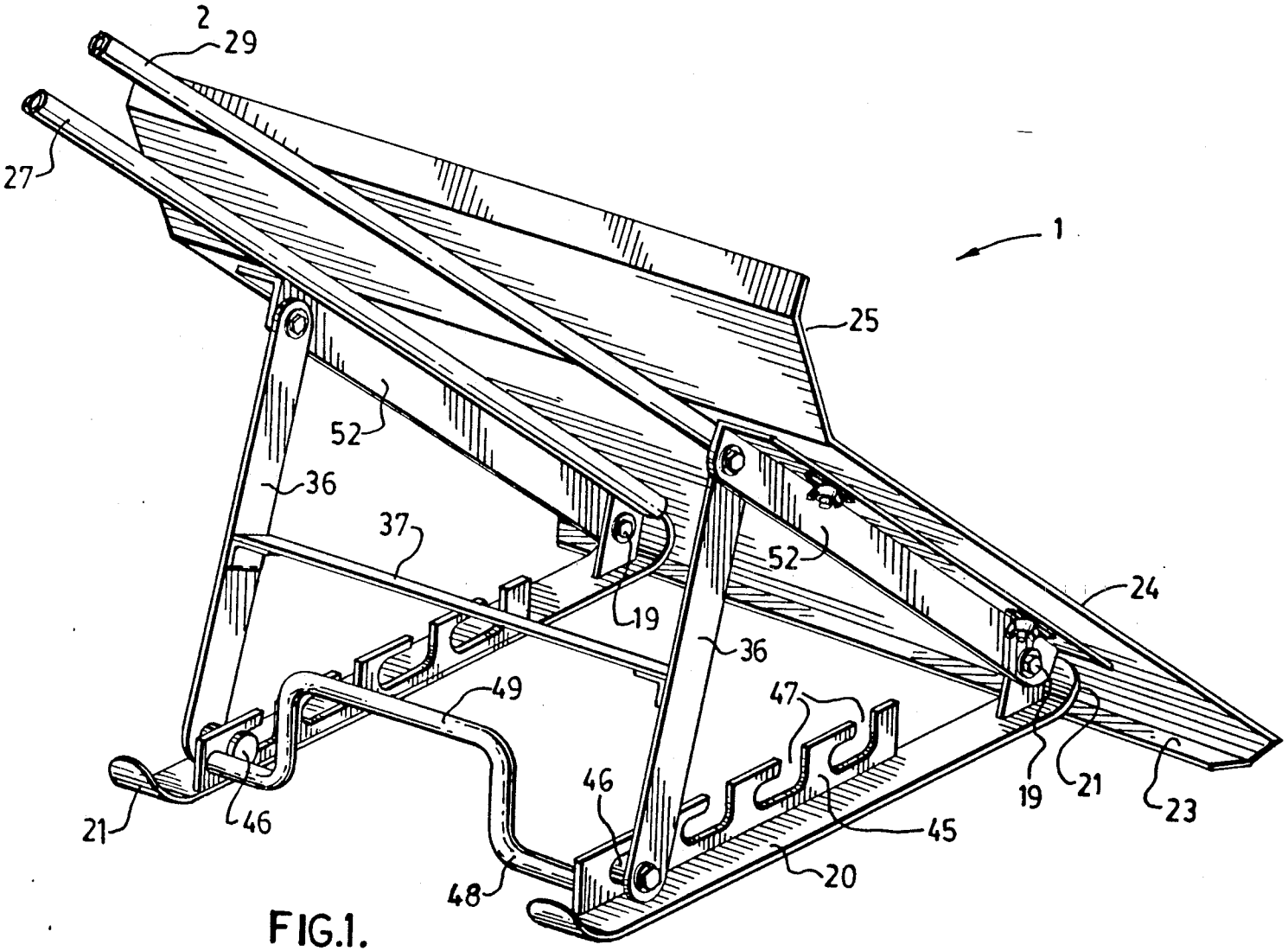
FIG. 1 is a perspective view of the preferred embodiment, showing the device in the pusher or plow configuration.
Figure 2:
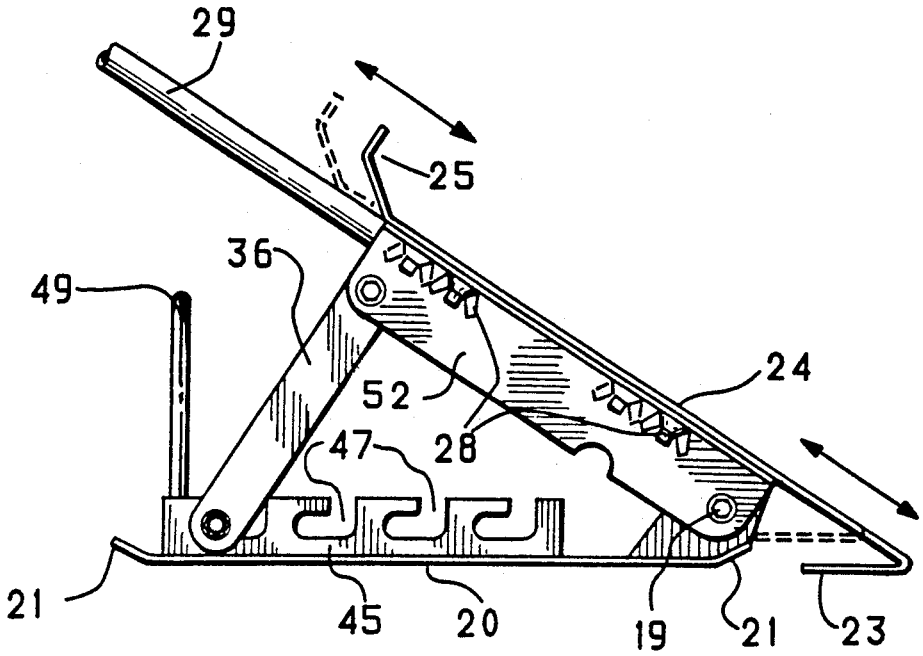
FIG. 2 is a side elevation of the device.
Figure 3:
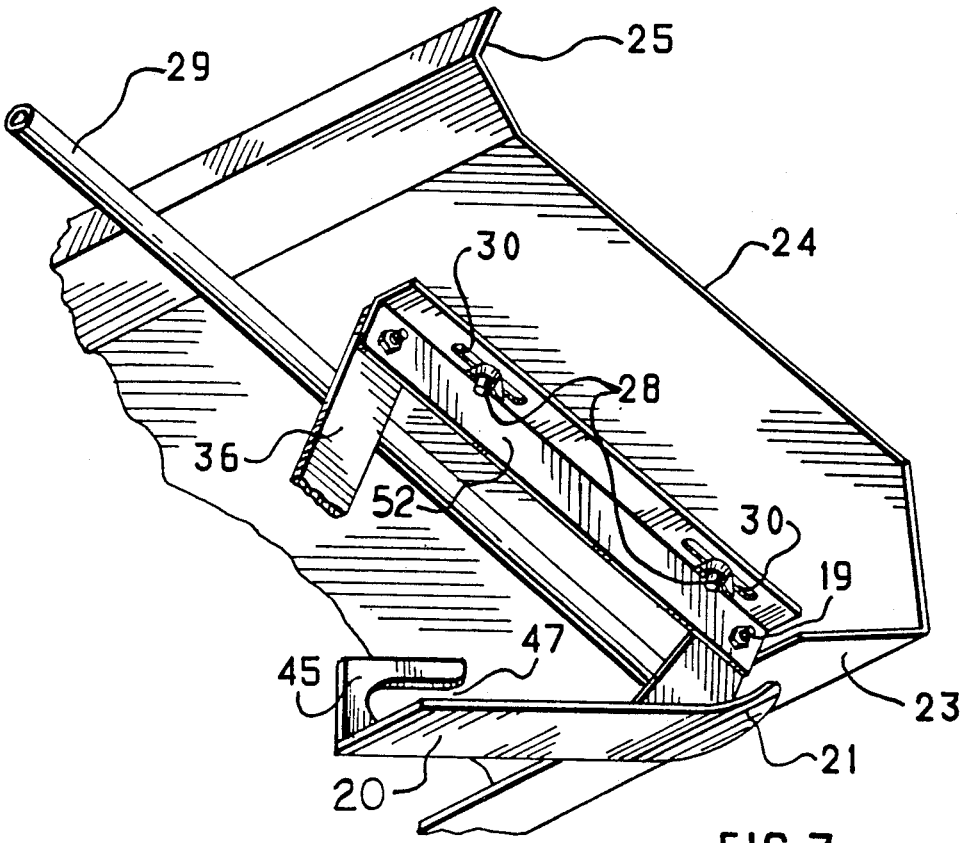
FIG. 3 is a perspective view of the area of underside of the blade.

The apparatus shown in the accompanying drawings and described below are examples which embody the invention. It should be noted that the scope of the invention is defined by the accompanying claims, and not necessarily by specific features of exemplary embodiments.

The snow pusher/shovel device 1 as shown in the drawings is arranged for use by a person 2 who is grasping the device in his hands 3, 4.

The device 1 may be used as a snow pusher for clearing a body of snow 13 down to a level 10. As shown, the device is used to clear snow over loose pebbles on a rough gravel surface. The level of snow left by the device is somewhat higher than the level of the pebbles.

The device includes a snow pushing blade 24. A reinforcing edge strip (not shown) may be attached to the lower edge of the blade 24, if desired. The lower edge of the blade may be provided with a curled-under portion 23 to reduce the likelihood of the blade "digging in". The top of the blade 24 is curled forwards, as at 25, in order that snow travelling up the blade 24 during pushing of the snow will roll over forwards, as at 14.

Attached to the blade 24 is a handle assembly 26 by means of which the device is held in the hands 3, 4 of the person 2. The handle assembly includes left and right side pieces 27, 29.

The blade 24 is secured to backing bars 52, which are welded or otherwise secured to the side pieces 27, 29 and which serve to stiffen the blade. Preferably, the securing of the blade to the backing bars is by the use of wingnuts 28, the backing bars being provided with slotted holes 30 so that the position of the blade relative to the backing bars, and hence relative to the runners or skis, may be adjusted. This allows the height of the blade to be set to a value wherein snow is cleared down reasonably close to the ground level, and yet wherein there is little danger that the blade will snag the ground.

The backing bars 52 serve also to receive the components of the foldable support runners, as will now be described. The device includes left and right foldable support runner assemblies. Each runner assembly includes a ski or skid 20. The ski 20 has turned-up ends 21 to allow the ski to pass over rough gravel without snagging the pebbles thereof.

The foldable support runner assembly comprises the suspension system, by means of which the skis 20 are mounted from the backing bars 52. The suspension system includes pivot pin connections 19 for the front of each ski, and left and right struts 36, with a connecting cross-piece 37.

At the bottom of the struts are pins 46 which engage L-shaped slots 47 in vertical flange pieces 45 projecting upwardly from the skis. Preferably these vertical flange pieces are integral to the skis.

Figure 8:
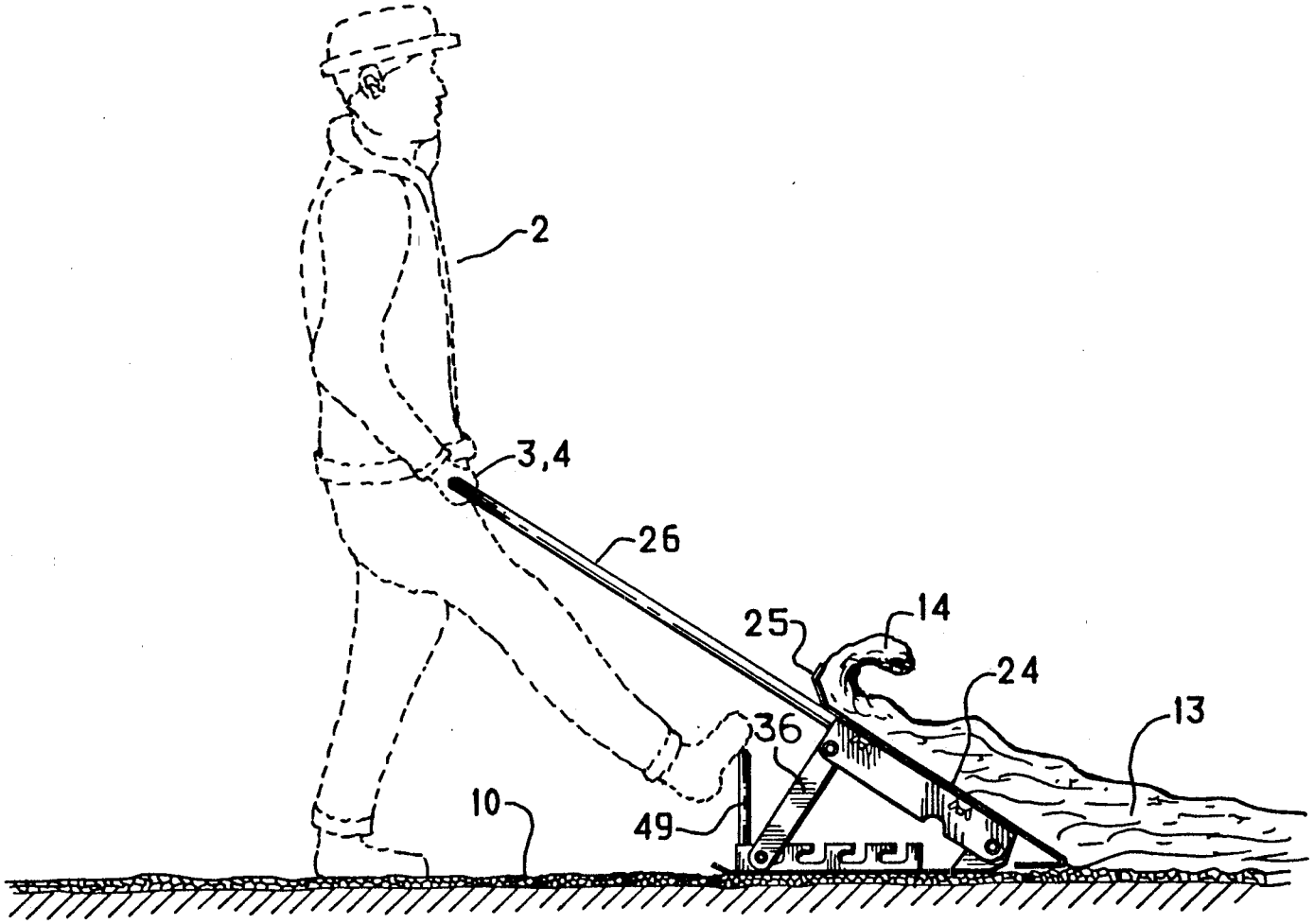
Figure 14:
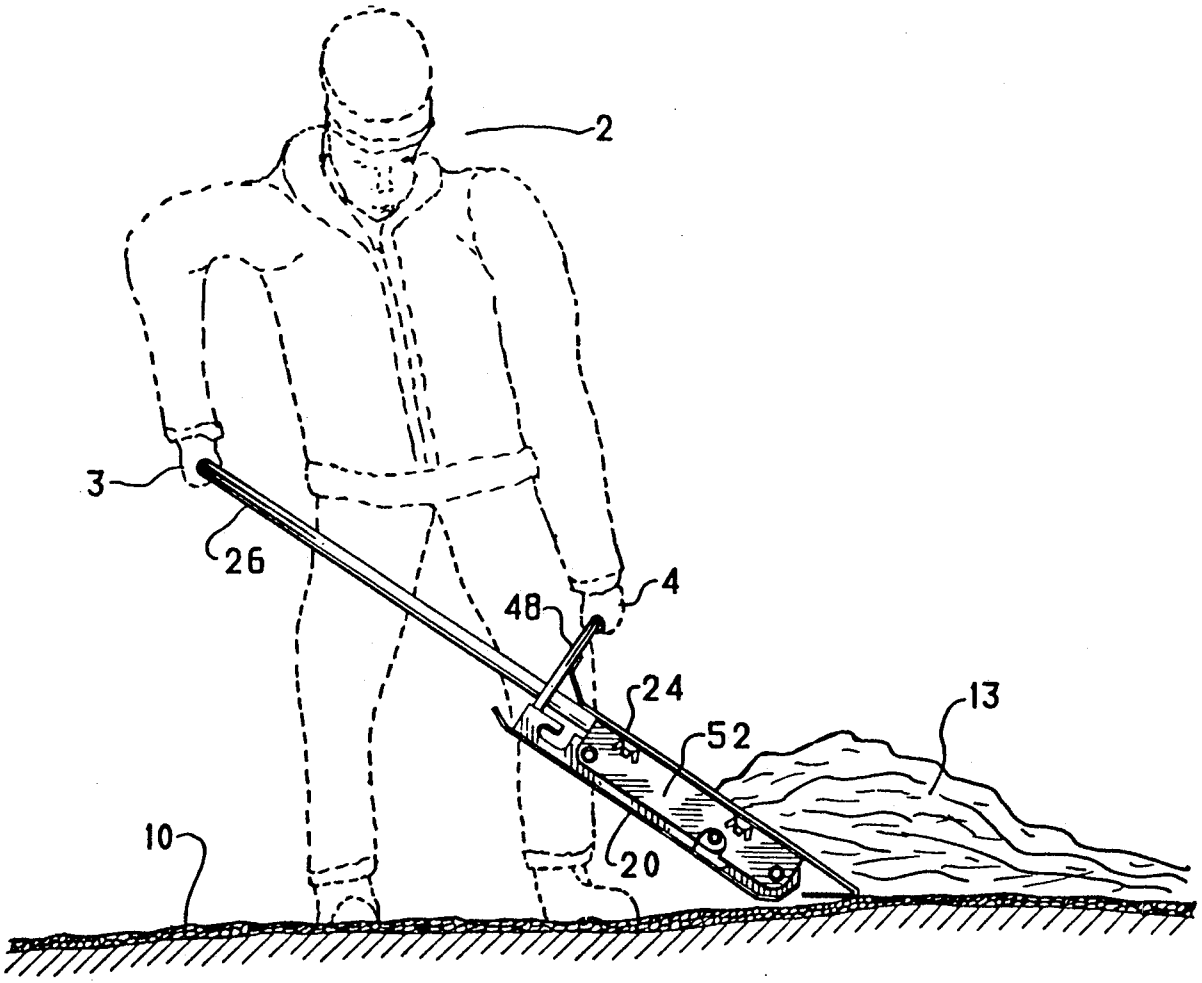
FIG. 14 is a side elevation view, showing the device in use as a shovel in the folded configuration.

Preferably the skis are connected by a cross-piece 48 which is formed to provide a lifting handle 49. As shown in FIG. 14, this lifting handle is used when the device is folded into the shovel configuration, or may be pushed against by the user's foot in the plow configuration, as shown in FIG. 8.

The fact that the suspension system of the device is easily collapsible is important for two reasons. First, the collapsibility needs to be simple in order to make the task of stowing the device away after use that much easier — together, of course, with the task of lifting the device down from its hook or hangar or other storage means, and preparing it for use.

Figure 7:
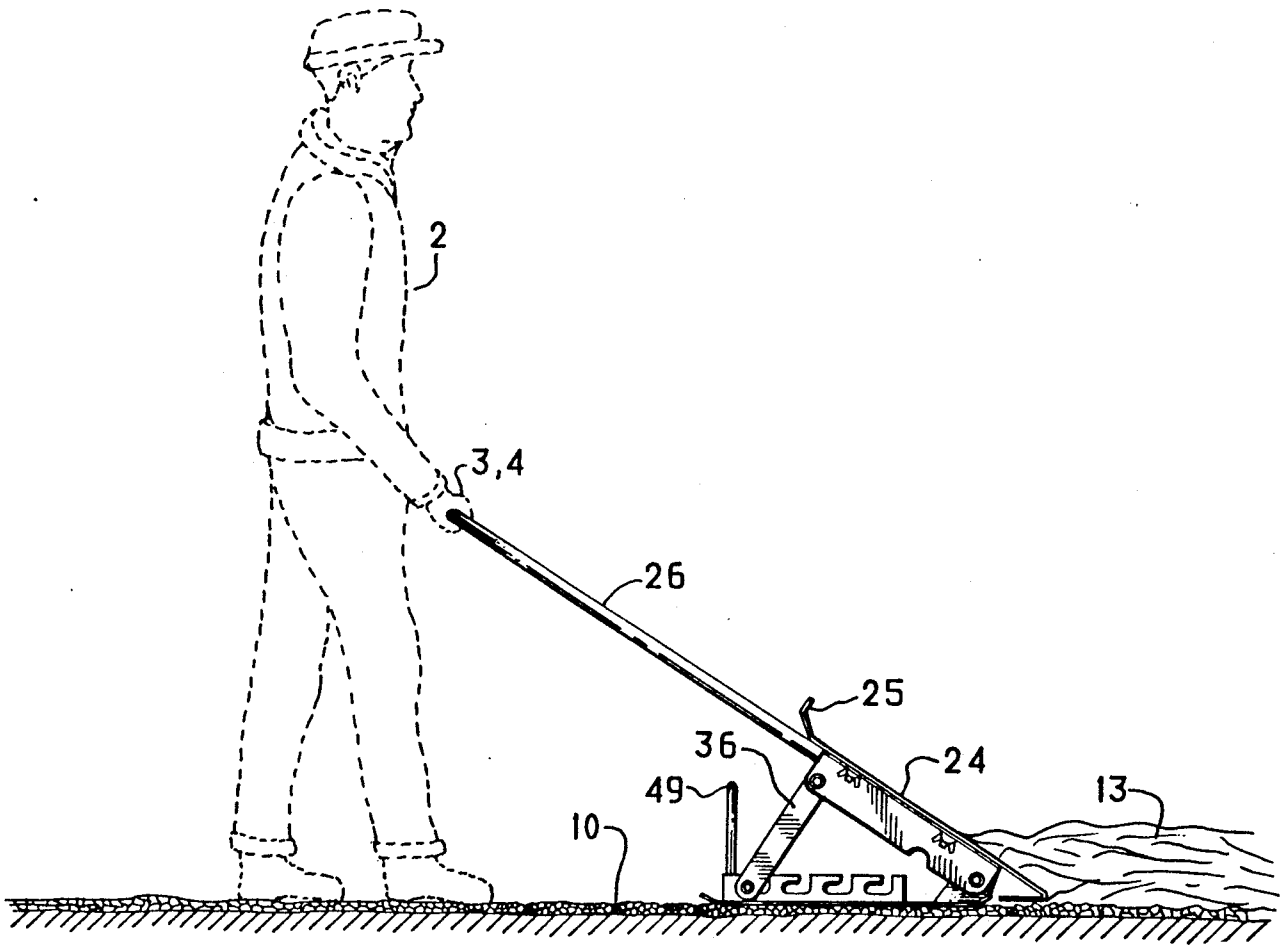
FIGS. 7, 8 and 9 are side elevation views, showing the device being used as a pusher or plow by a person.
Figure 9:
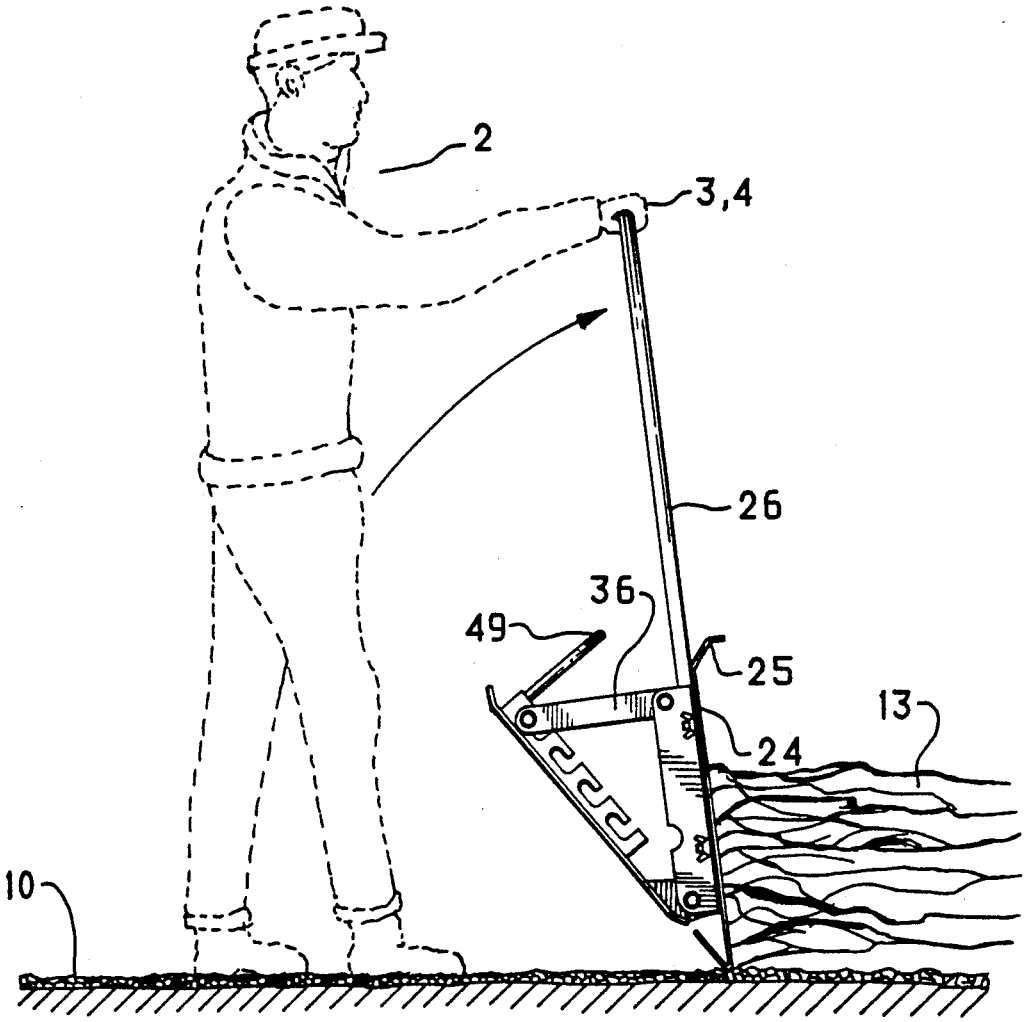

The second reason why easy collapsibility is important lies in the fact that the person requires to change, while clearing the driveway, from using the device as a pusher or snow-plow to using the device as a shovel. This change occurs for example after the person has been using the device as a pusher, in the sequence of steps shown in FIGS. 7–9, and the blade then reaches the edge of the driveway: that is to say, when the person has pushed a pile of snow to the edge of the driveway as shown in FIG. 9.

Now, the person wishes to lift the piled-up snow and place it out of the way: for example, by piling the snow onto a heap or banking; or by throwing the snow onto, say, a piece of clear ground, such as a lawn, adjacent to the driveway; or perhaps even by lifting the piled-up snow into a wheelbarrow for more distant disposal.

Figure 11:
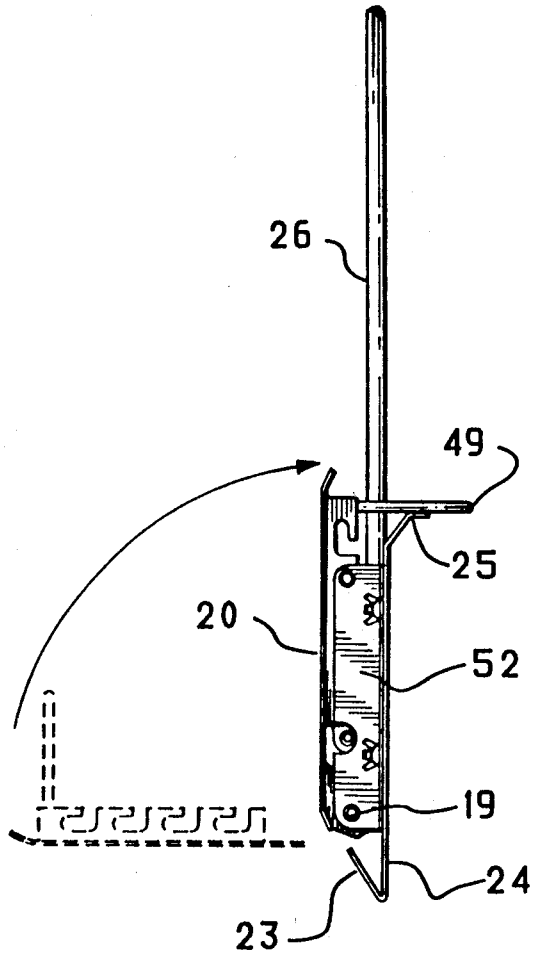
FIGS. 10 and 11 are side views showing the device being folded into the shovel configuration.
Figure 10:
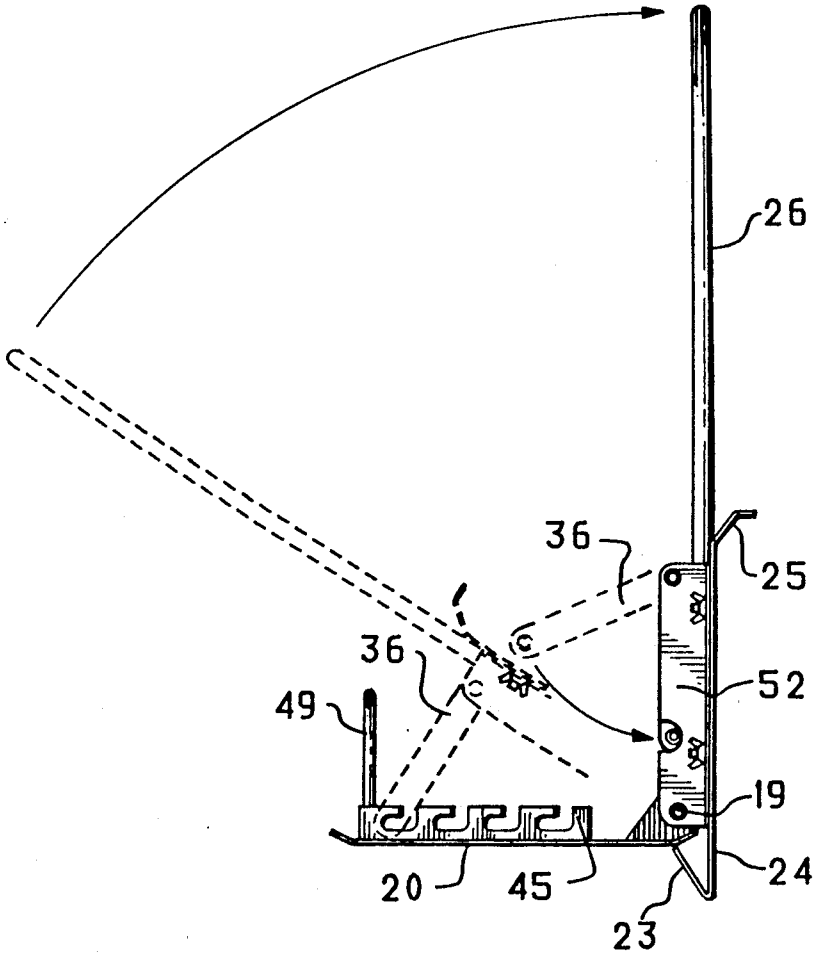
Figure 12:
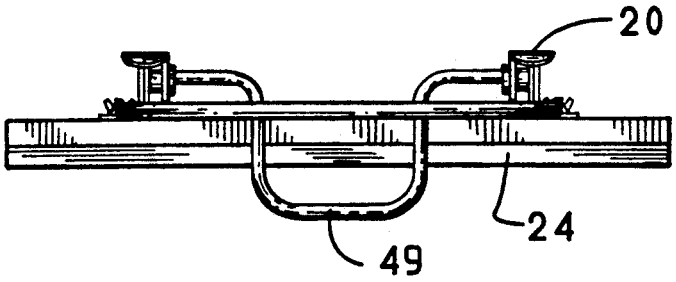
FIG. 12 is a top view showing the folded device.
Figure 13:
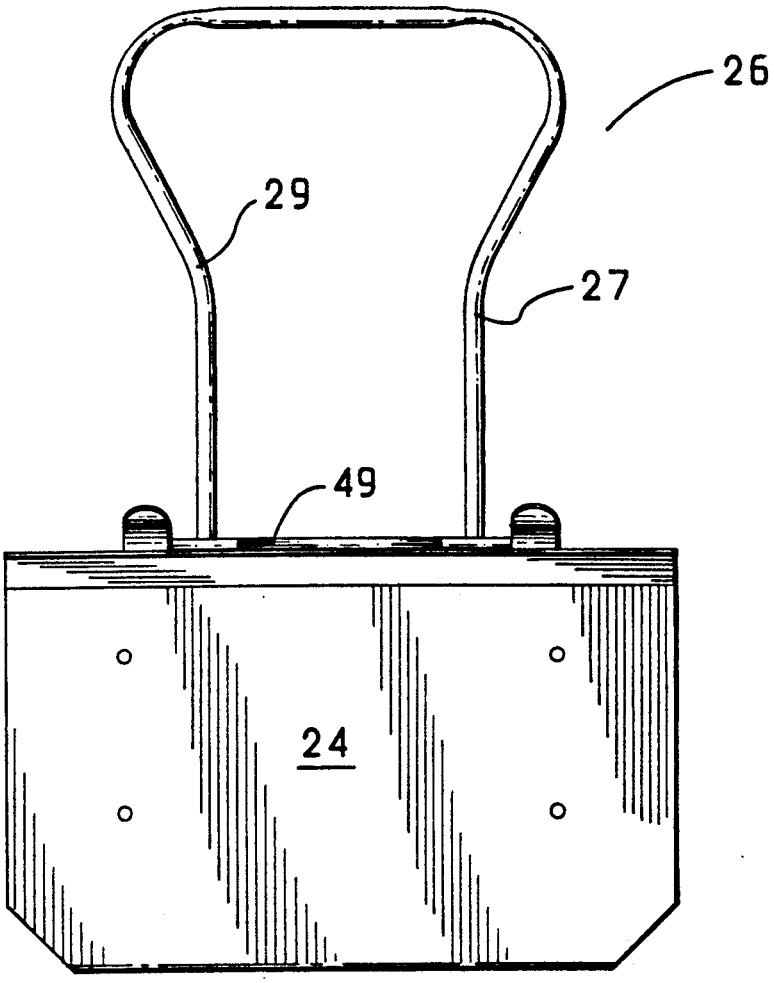
FIG. 13 is a front view showing the folded device.

With the device of the invention, to change to shovel-mode, the person simply manually adjusts the suspension system from the extended condition to the collapsed or folded condition, as shown in FIGS. 10 and 11. Upon his doing so, the device is immediately ready for use as a shovel.

After the person has disposed of that particular portion of piled-up snow, he may wish to continue with clearing the driveway. In that case, he then simply re-extends the suspension system, and reverts to using the device in the pusher or plow mode.

A person needs to have two tools at hand when clearing a driveway, i.e. both a pusher and a shovel. The device of the invention provides him with both tools in one, and allows him to change from one to the other very readily.

It should be noted that it would seriously detract from the ease of use of the device if the person needed, for example, to use a wrench or the like to effect the changeover of the runner suspension system. This applies not only to preparing the device for use and for stowing it away after use, but applies especially during the actual operation of the device.

Figure 4:
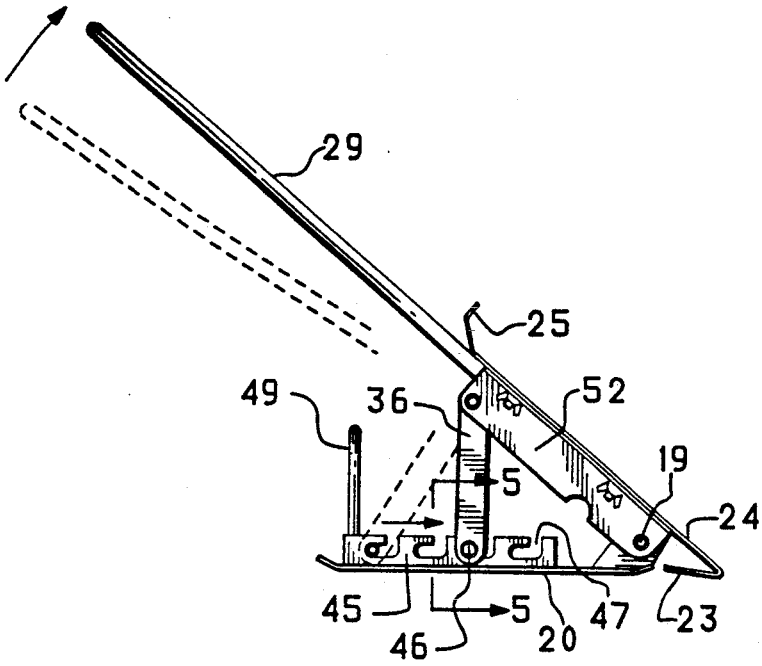
FIG. 4 is a side elevation view illustrating varying the angle of the blade.
Figure 5:
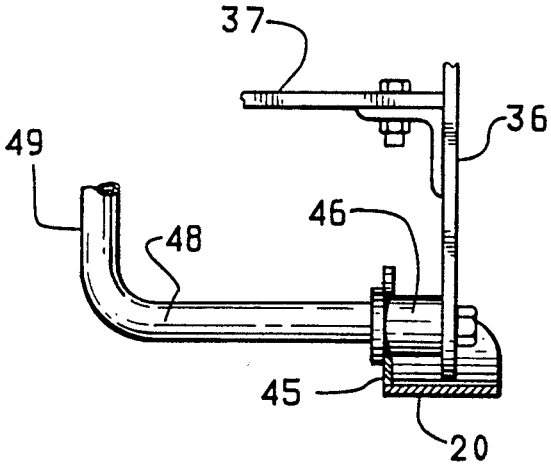
FIG. 5 is a cross-section at 5—5 in FIG. 4.
Figure 6:
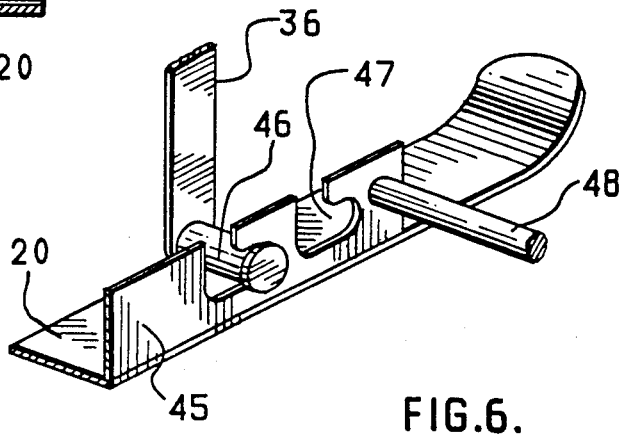
FIG. 6 is a perspective view of the locking arrangement.

As shown in FIG. 4, the angle of the blade relative to the skis may be readily adjusted, if desired, by selecting different slots 47 for the pins 46 to engage.

It is important that the two skis 20 be spaced wide enough apart that the blade 24 is properly supported against lateral or sideways tipping. In prior art devices where the lower front edge of the blade rests against the ground, the blade was of course inherently unable to tip (though, as noted, the blade could snag and dig into the ground surface), and only a single ski was needed in order to support the blade. However, when the blade is supported some distance clear of the ground, e.g. about 5 cm. as may be typical in the device described, the blade would inevitably tend to slip sideways, and it would require considerable strength and manipulative skills on the part of the user to keep the blade straight.

Therefore it is preferred that the skis or runners be so arranged as to prevent sideways tipping of the blade, and the provision of the two skis, spaced well apart across the width of the blade, as described, is a preferred manner in which this can be achieved.

It will be appreciated that many variations on the specific embodiment described above will be obvious to many persons, and such obvious variations are considered to be within the scope of the invention as defined by the claims, whether or not expressly described above.

As one example only, it should be apparent that the specific mechanism for supporting the skis could be readily varied, i.e. the invention is not limited to the specific configuration involving the pins 46 in slots 47.

What is claimed as the invention is:

1. A snow shovel/pusher device, comprising:

a blade, having a lower edge, an upper edge, and two opposite side edges;

a handle attached to the blade and extending upwardly therefrom;

two elongated laterally spaced-apart runners having a front and rear ends, said runners being pivotally connected with respect to said blade, near the front ends of said runners and the lower edge of said blade; and strut means pivotally connected to an upper portion of said blade, arranged to be operable between two positions, namely a folded position against said blade, in which said runners may also be folded against said blade, and an extended position where said strut means project away from said blade at a substantial angle, towards a rearward portion of said runners, and engageable therewith to support said blade at a substantial angle from said runners.

2. Device of claim 1, wherein the arrangement of the strut means is such that when the runners are in the extended position, and when the runners are in contact with the ground, the angle and position of the runners relative to the blade is such that the said loweredge of the blade is clear of the ground surface.

3. Device of claim 2, wherein, when the runners are in operative contact with the ground surface, the said lower edge of the blade is clear of the ground surface by a height of about 5 cm.

4. Device of claim 1, wherein the strut means includes a locking means whereby the strut is prevented, during operation of the device with the runners in the extended position, from collapsing.

5. Device of claim 4, wherein the strut means includes two struts, being a left strut and a right strut, spaced apart in general alignment with said runners.

6. Device of claim 5, wherein lower ends of said struts have pins projecting therefrom which engage corresponding slots in vertical flanges projecting upwardly from said runners.

7. Device of claim 5, wherein said struts are connected by a cross-piece, said cross-piece having an upwardly-projecting portion which is operative as a handle when the device is in said folded position for operation as a shovel.

8. Device of claim 1, where the relative positions of said handle and said blade are adjustable, whereby the height of said blade above said runners may be adjusted.

* * * * *